US010539138B2

(12) United States Patent
Lu et al.

(10) Patent No.: US 10,539,138 B2
(45) Date of Patent: Jan. 21, 2020

(54) OIL-INJECTED SCREW AIR COMPRESSOR

(71) Applicants: ALMiG Kompressoren GmbH, Köngen (DE); FUSHENG INDUSTRIAL (SHANGHAI) CO., LTD, Shanghai (CN)

(72) Inventors: Ming-Te Lu, New Taipei (TW); Viktor Weber, Kenzingen (DE); Sheng-Kun Chen, Shanghai (CN); Li-Yung Yan, New Taipei (TW)

(73) Assignees: ALMIG KOMPRESSOREN GMBH, Köngen (DE); FUSHENG INDUSTRIAL (SHANGHAI) CO., LTD, Shanghai (CN)

( * ) Notice: Subject to any disclaimer, the term of this patent is extended or adjusted under 35 U.S.C. 154(b) by 223 days.

(21) Appl. No.: 15/632,386

(22) Filed: Jun. 25, 2017

(65) Prior Publication Data

US 2018/0119602 A1 May 3, 2018

(30) Foreign Application Priority Data

Oct. 28, 2016 (EP) ..... 16196221

(51) Int. Cl.
*F01P 3/20* (2006.01)
*F04C 29/00* (2006.01)
(Continued)

(52) U.S. Cl.
CPC ..... *F04C 29/0007* (2013.01); *F01P 3/20* (2013.01); *F02B 23/04* (2013.01); *F02M 26/47* (2016.02);
(Continued)

(58) Field of Classification Search
CPC .... F04C 18/16; F04C 29/0014; F04C 23/001; F04C 2270/195; F04C 2270/185;
(Continued)

(56) References Cited

U.S. PATENT DOCUMENTS 5,328,344 A * 7/1994 Sato ..... F01C 21/102 417/367
2004/0217180 A1* 11/2004 Lu ..... F04C 29/0007 236/44 C
2008/0279708 A1* 11/2008 Heimonen ..... F04C 29/0014 418/84

FOREIGN PATENT DOCUMENTS

CN 1031361 C 3/1996
CN 201401311 Y 2/2010
(Continued)

*Primary Examiner* — Peter J Bertheaud
*Assistant Examiner* — Dnyanesh G Kasture
(74) *Attorney, Agent, or Firm* — CKC & Partners Co., LLC

(57) ABSTRACT

An oil-injected screw air compressor includes a first stage compression chamber, an air buffering chamber coupled to the first stage compression chamber, a second stage compression chamber coupled to the air buffering chamber, a first oil cooling device for cooling lubricating oil for the first stage compression chamber and the air buffering chamber, a second oil cooling device for cooling lubricating oil for the second stage compression chamber and the first oil cooling device, a plurality sensors respectively located at the first stage compression chamber outlet and the second stage compression chamber outlet, and a control unit respectively and dynamically controlling the first oil cooling device and the second oil cooling device according to preset pressure and temperature data measured by the sensors or pressure and temperature data measured by the sensors, and temperature data and humidity data of an environment.

10 Claims, 1 Drawing Sheet

(51) Int. Cl.

| | |
|---|---|
| ***F02M 26/47*** | (2016.01) |
| ***F02B 23/04*** | (2006.01) |
| ***F02M 53/08*** | (2006.01) |
| *F02D 41/14* | (2006.01) |

(52) U.S. Cl.
CPC ..... *F02M 53/08* (2013.01); *F04C 29/0014* (2013.01); *F02D 41/1441* (2013.01)

(58) Field of Classification Search
CPC ..... F04C 2210/1005; F04C 15/0096; F04C 29/0007; F04C 29/042; F02M 26/47; F02M 53/08; F02B 23/04; F02D 41/1441; F01P 3/20; F01P 2060/04
See application file for complete search history.

(56) References Cited

FOREIGN PATENT DOCUMENTS

| | | | |
|---|---|---|---|
| CN | 103967791 | A | 8/2014 |
| CN | 104121199 | A | 10/2014 |
| CN | 104676935 | A | 6/2015 |
| WO | 02/46617 | A | 6/2002 |

* cited by examiner

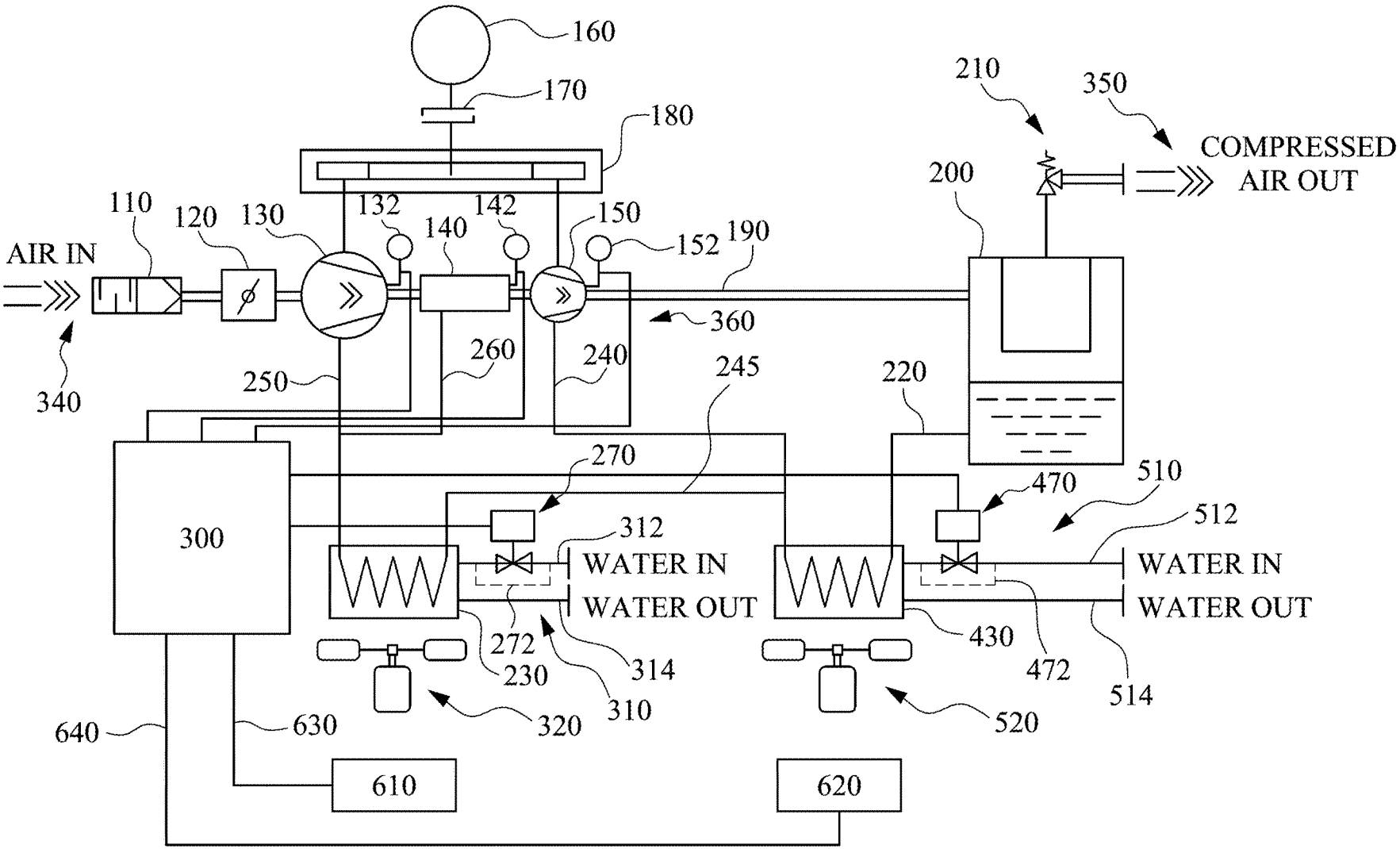
COMPRESSED AIR OUT
350
210
200
WATER IN
WATER OUT
512
510
514
470
472
430
520
220
620
190
360
245
152
180
150
240
270
312
WATER IN
WATER OUT
314
310
160
170
142
260
272
230
320
140
132
610
130
250
630
120
300
110
AIR IN
340
640

OIL-INJECTED SCREW AIR COMPRESSOR

RELATED APPLICATIONS

This application claims priority to European Patent Application No. 16196221.2, filed Oct. 28, 2016, which is herein incorporated by reference.

TECHNICAL FIELD

The present disclosure generally relates to a screw air compressor. More particularly, the present disclosure relates to an oil-injected screw air compressor.

BACKGROUND

Screw air compressors have been widely used to provide compressed air in industry. The screw air compressor includes two rotors mounted in a working room. Each rotor is provided with helically extending lobes and grooves which are intermeshed to establish compression cavities. In these cavities, a gaseous fluid is displaced and compressed from an inlet channel to an outlet channel by way of the screw compressor.

Each compression cavity during a filling phase communicates with the inlet, during a compression phase undergoes a continued reduction in volume, and during a discharge phase communicates with an outlet. Screw air compressors are often provided with valves for regulating the built-in volume ratio for the capacity of the compressor.

The efficiency of the screw air compressors plays an important role in the energy consumed at the entire factory. For the effective use of the screw air compressors to reduce the energy consumption, there is a need to provide a more efficient, safe, and reliable screw air compressor.

SUMMARY

One objective of the embodiments of the present invention is to provide an oil-injected screw air compressor having a control unit and at least two oil cooling devices to dynamically control the temperature of the lubricating oil to maintain the temperature of the compressed air higher than pressure dew point according to the measured temperature, humidity and pressure data.

To achieve these and other advantages and in accordance with the objective of the embodiments of the present invention, as the embodiment broadly describes herein, the embodiments of the present invention provides an oil-injected screw air compressor having a first stage compression chamber, an air buffering chamber coupled to the first stage compression chamber, a second stage compression chamber coupled to the air buffering chamber, a first oil cooling device for cooling lubricating oil for the first stage compression chamber and the air buffering chamber, a second oil cooling device for cooling lubricating oil for the second stage compression chamber and the first oil cooling device, a plurality sensors respectively located at the outlets of the first stage compression and the second stage compression, and a control unit respectively and dynamically controlling the first oil cooling device and the second oil cooling device according to preset pressure and temperature data measured by the sensors or pressure and temperature data measured by the sensors, and temperature data and humidity data of an environment.

In one embodiment, the first oil cooling device and the second oil cooling device are connected in series or in parallel.

In one embodiment, the first oil cooling device further includes a first water inlet pipe, a first water outlet pipe, and a first control valve equipped in the first water inlet or outlet pipe and controlled by the control unit so as to control a temperature of the lubricating oil for the first stage compression chamber and the air buffering chamber, and the second oil cooling device further includes a second water inlet pipe, a second water outlet pipe, and a second control valve equipped in the second water inlet or outlet pipe and controlled by the control unit so as to control a temperature of the lubricating oil for the second stage compression chamber and the first oil cooling device.

In one embodiment, the first oil cooling device comprises a first cooling fan and a first frequency converter controlled by the control unit so as to control a temperature of the lubricating oil for the first stage compression chamber and the air buffering chamber, and the second oil cooling device includes a second cooling fan and a second frequency converter controlled by the control unit so as to control a temperature of the lubricating oil for the second stage compression chamber and the first oil cooling device.

In one embodiment, alternately, the first oil cooling device includes the first control valve that is controlled by the control unit to dynamically control the flow rate of a water entering into the first oil cooling device according to the pressure and temperature data measured by the sensors and the temperature data and the humidity data of the environment to maintain the outlet temperatures of compressed air of the first stage compression chamber and the air buffering chamber higher than modified pressure dew point temperatures, i.e. the pressure dew point temperature plus 6 to 10 degrees Celsius, of the first stage compression chamber and the air buffering chamber.

In one embodiment, alternately, the second oil cooling device includes that the second control valve is controlled by the control unit to dynamically control the flow rate of a water entering into the second oil cooling device according to the pressure and temperature data measured by the sensors and the temperature data and the humidity data of the environment to maintain the outlet temperature of compressed air of the second stage compression higher than a modified pressure dew point temperature, i.e. the pressure dew point temperature plus 6 to 10 degrees Celsius, of the second stage compression chamber.

In one embodiment, an oil inlet of the first oil cooling device is connected to an oil outlet of the second oil cooling device.

In one embodiment, the first control valve is a bypass control valve to maintain a minimum flow rate of water of the first oil cooling device, and the second control valve is a bypass control valve to maintain a minimum flow rate of water of the second oil cooling device.

In one embodiment, the oil-injected screw air compressor further includes a first bypass pipe to maintain a minimum flow rate of water of the first oil cooling device, and a second bypass pipe to maintain a minimum flow rate of water of the second oil cooling device.

In one embodiment, the oil-injected screw air compressor further includes an oil separating tank to separate the lubricating oil from compressed air.

In one embodiment, the oil-injected screw air compressor further includes a motor, a transmission device and a gear box to distribute power to the first stage compression chamber and the second stage compression chamber, and a suction filter and a suction throttle valve at an air inlet of the oil-injected screw air compressor.

The oil-injected screw air compressor according to one embodiment of the present invention utilizes at least two oil cooling devices and sensors for detecting the pressures and outlet temperatures of the first stage compression chamber, the air buffering chamber, the second stage compression chamber and the temperature and humidity of the environment to automatically control the temperatures of the compressed air to prevent the water vapor in the compressed air from condensing into the liquid water. The flow rates of the cooling water of the first oil cooling device and second oil cooling device are dynamically and respectively controlled by the control unit according to the feedback measured data. Therefore, the oil-injected screw air compressor can be operated close to an isothermal compression condition all the year round, regardless of winter or summer season. The efficiency of the oil-injected screw air compressor is therefore increased.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein:

FIG. 1 illustrates a schismatic diagram showing an oil-injected screw air compressor according to one embodiment of the present invention.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Referring to FIG. 1, a schismatic diagram showing an oil-injected screw air compressor according to one embodiment of the present invention is illustrated. The oil-injected screw air compressor 100 includes two compression chambers, e.g. a first stage compression chamber 130 and a second stage compression chamber 150, an air buffering chamber 140 coupled to the first stage compression chamber 130 and the second stage compression chamber 150, and an oil separating tank 200 coupled to the second stage compression chamber 150 with an air pipe 190.

The first stage compression chamber 130 and the second stage compression chamber 150 are driven by a motor 160 through a transmission device 170, i.e. a coupling, and a gear box 180 to distribute power to the first stage compression chamber 130 and the second stage compression chamber 150. The oil-injected screw air compressor 100 absorbs air from the air inlet 340 into the first stage compression chamber 130 via a suction filter 110 and a suction throttle valve 120, is then compressed and discharged into the air buffering chamber 140. The air stored in the air buffering chamber 140 is then be absorbed into the second stage compression chamber 150 and compressed and discharged into an oil separating tank 200 through an air pipe 190. The oil, i.e. the lubricating oil, accumulated at the bottom of the oil separating tank 200 is delivered into a second oil cooling device 430 through a high temperature oil pipe 220. The temperature of the high temperature oil is then cooled down by the second oil cooling device 430. The oil is then delivered into the second stage compression chamber 150 through a second stage lubricating oil pipe 240, and the first oil cooling device 230 through a medium temperature oil pipe 245.

Some of the oil is delivered to the first oil cooling device 230 and cooled down by the first oil cooling device 230 again. Subsequently, the oil is delivered into the first stage compression chamber 130 through a first stage lubricating oil pipe 250 and the air buffering chamber 140 through an air buffering chamber lubricating oil pipe 260. The oil inlet of the first oil cooling device 230 can be the oil outlet of the second oil cooling device 430 because the medium temperature oil pipe 245 connects the second oil cooling device 430 to the first oil cooling device 230. Therefore, the first oil cooling device 230 and the second oil cooling device 430 are connected in series. Alternatively, the oil inlet of the first oil cooling device 230 can also be connected to the oil separating tank 200. That is to say, the first oil cooling device 230 and the second oil cooling device 430 can be connected in series or in parallel.

In one embodiment, the first oil cooling device 230 includes a cooling water pipe 310 to provide the cooling water for cooling the medium temperature oil. The cooling water pipe 310 further includes a water inlet pipe 312 and a water outlet pipe 314 to supply and drain the cooling water. The second oil cooling device 430 includes a cooling water pipe 510 to provide the cooling water for cooling the high temperature oil. The cooling water pipe 510 further includes a water inlet pipe 512 and a water outlet pipe 514 to supply and drain the cooling water.

In addition, a first control valve 270 is equipped in the water inlet pipe 312 and controlled by a control unit 300, and a second control valve 470 is equipped in the water inlet pipe 512 and also controlled by the control unit 300.

The control unit 300 separately determines the flow rates of the water entering into the first oil cooling device 230 and the second oil cooling device 430 according to atmospheric temperature and humidity of the environment, and the outlet pressures and outlet temperatures of the first stage compression chamber 130, the second stage compression chamber 150 and the air buffering chamber 140. Therefore, the flow rate of the water in the water inlet pipe 312 is decreased while the temperature at the outlet of the first stage compression chamber 130 or the air buffering chamber 140 is too low, e.g. lower than the modified pressure dew point temperature thereof. For example, the modified pressure dew point temperature of the first stage compression chamber 130 or the air buffering chamber 140 is the pressure dew point temperature of the first stage compression chamber 130 or the air buffering chamber 140 plus 6 to 10 degrees Celsius. The flow rate of the water in the water inlet pipe 312 is increased while the temperature at the outlet of the first stage compression chamber 130 or the air buffering chamber 140 is too high, e.g. higher than the modified pressure dew point temperature thereof.

With the same manner, the flow rate of the water in the water inlet pipe 512 is decreased while the temperature at the outlet of the second stage compression chamber 150 is too low, e.g. lower than the modified pressure dew point temperature thereof. For example, the modified pressure dew point temperature of the second stage compression chamber 150 is the pressure dew point temperature of the second stage compression chamber 150 plus 6 to 10 degrees Celsius. The flow rate of the water in the water inlet pipe 512 is increased while the temperature at the outlet of the second stage compression chamber 150 is too high, e.g. higher than the modified pressure dew point temperature thereof.

In one embodiment, the temperature at the outlet of the first stage compression chamber 130 is controlled at about 8 degrees Celsius higher than the first stage pressure dew point e.g. 70 degrees Celsius, the temperature at the outlet of the second stage compression chamber 150 is controlled at about 10 degrees Celsius higher than the second stage pressure dew point e.g. 90 degrees Celsius, and the temperature at the outlet of air buffering chamber 140 is controlled at about 6 degrees Celsius higher than the first stage pressure dew point e.g. 68 degrees Celsius because that the pressure of the outlet of the second stage compression chamber 150 is higher than those of the first stage compression chamber 130 and the air buffering chamber 140.

The control unit 300 separately and dynamically controls the first control valve 270 and the second control valve 470 to further control the flow rate of the water in the first oil cooling device 230 and the second oil cooling device 430 according to the temperature and the humidity of the environment, and the pressures and temperature of the first stage compression chamber 130, the second stage compression chamber 150, and the air buffering chamber 140 with sensors 132 located at the outlet of the first stage compression chamber 130, sensors 152 located at the outlet of the second stage compression chamber 150 and sensors 142 located at the outlet of the air buffering chamber 140 to respectively and dynamically maintain the output temperatures of the compressed air higher than a modified pressure dew point temperature at the outlets thereof. Therefore, the control unit 300 can automatically and individually controls the flow rate of the cooling water by way of the first control valve 270 and the second control valve 470. The measured temperature and pressure data are transmitted to the control unit 300 through circuits 360. In addition, the temperature and humidity data of the environment can also be detected by the control unit 300 or be sent to the control unit 300 by other equipment.

In one embodiment, the first control valve 270 and the second control valve 470 further include a bypass pipe 272 and a bypass pipe 472, or the first control valve 270 and the second control valve 470 further include bypass function therein to respectively maintain a minimum flow rate of the cooling water for the first oil cooling device 230 and the second oil cooling device 430. The control valves with bypass pipes or function can be alternately installed in water outlet pipe.

In one embodiment, alternately, the first oil cooling device 230 includes a first cooling fan 320 for cooling the medium temperature oil and a first frequency converter 610 controlled by the control unit 300 through circuit 630 to control the first cooling fan 320 for maintaining the lubricating oil in a desired temperature for the first stage compression chamber 130 and the air buffering chamber 140. In one embodiment, alternately, the second oil cooling device 430 includes a second cooling fan 520 for cooling the high temperature oil and a second frequency converter 620 controlled by the control unit 300 through circuit 640 to control the second cooling fan 520 for maintaining the lubricating oil in a desired temperature for the second stage compression chamber 150 and the first oil cooling device 230. In the regard, the first cooling device 230 can utilize the cooling water pipe 310 to provide the cooling water for cooling the medium temperature oil or utilize the first cooling fan 320 for cooling the medium temperature oil. Similarly, the second oil cooling device 430 can utilize the cooling water pipe 510 to provide the cooling water for cooling the high temperature oil or utilize the second cooling fan 520 for cooling the high temperature oil.

In one embodiment, a pressure valve 210, e.g. a pressure maintenance valve, is equipped in the oil separating tank 200 to maintain the compressed air pressure for the oil-injected screw air compressor 100 and supply the compressed air to the required equipment through an air outlet 350.

The oil-injected screw air compressor according to one embodiment of the present invention utilizes at least two oil cooling devices and sensors for detecting the outlet pressures and outlet temperatures of the first stage compression chamber, the air buffering chamber, the second stage compression chamber and the temperature and humidity of the environment to automatically control the temperatures of the compressed air by controlling oil temperature to prevent the water vapor in the compressed air from condensing into the liquid water. The flow rates of the cooling water of the first oil cooling device and second oil cooling device are dynamically and respectively controlled by the control unit according to the feedback measured data. Therefore, the oil-injected screw air compressor can be operated close to an isothermal compression condition all the year round, regardless of winter or summer season. The efficiency of the oil-injected screw air compressor is therefore increased.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. An oil-injected screw air compressor, comprising:

a first stage compression chamber;

an air buffering chamber coupled to the first stage compression chamber;

a second stage compression chamber coupled to the air buffering chamber;

a first oil cooling device for cooling lubricating oil for the first stage compression chamber and the air buffering chamber;

a second oil cooling device for cooling lubricating oil for the second stage compression chamber and the first oil cooling device, wherein the first oil cooling device and the second oil cooling device are connected through an oil pipe;

a plurality of sensors respectively located at the first stage compression chamber and the second stage compression chamber; and a control unit respectively and dynamically controlling the first oil cooling device and the second oil cooling device according to pressure and temperature data measured by the sensors, and temperature data and humidity data of an environment.

2. The oil-injected screw air compressor of claim 1, wherein the first oil cooling device further comprises a first water inlet pipe, a first water outlet pipe, and a first control valve equipped in the first water inlet pipe and controlled by the control unit so as to control a temperature of the lubricating oil for the first stage compression chamber and the air buffering chamber, and the second oil cooling device further comprises a second water inlet pipe, a second water outlet pipe, and a second control valve equipped in the second water inlet pipe and controlled by the control unit so as to control a temperature of the lubricating oil for the second stage compression chamber and the first oil cooling device.

3. The oil-injected screw air compressor of claim 1, wherein the first oil cooling device further comprises a first cooling fan and a first frequency converter controlled by the control unit so as to control a temperature of the lubricating oil for the first stage compression chamber and the air buffering chamber, and the second oil cooling device further comprises a second cooling fan and a second frequency converter controlled by the control unit so as to control a temperature of the lubricating oil for the second stage compression chamber and the first oil cooling device.

4. The oil-injected screw air compressor of claim 2, wherein the first control valve is controlled by the control unit to dynamically control the flow rate of a water entering into the first oil cooling device according to the pressure and temperature data measured by the sensors and the temperature data and the humidity data of the environment to maintain the temperatures of compressed air of the first stage compression chamber and the air buffering chamber higher than modified pressure dew point temperatures of the first stage compression chamber and the air buffering chamber.

5. The oil-injected screw air compressor of claim 4, wherein the second control valve is controlled by the control unit to dynamically control the flow rate of a water entering into the second oil cooling device according to the pressure and temperature data measured by the sensors and the temperature data and the humidity data of the environment to maintain the temperatures of compressed air of the second stage compression chamber higher than a modified pressure dew point temperature of the second stage compression chamber.

6. The oil-injected screw air compressor of claim 5, wherein an oil inlet of the first oil cooling device is connected to an oil outlet of the second oil cooling device, or the first oil cooling device is directly connected to an oil separating tank.

7. The oil-injected screw air compressor of claim 2, wherein the first control valve is a bypass control valve to maintain a minimum flow rate of water of the first oil cooling device, and the second control valve is a bypass control valve to maintain a minimum flow rate of water of the second oil cooling device.

8. The oil-injected screw air compressor of claim 2, further comprising a first bypass pipe to maintain a minimum flow rate of water of the first oil cooling device, and a second bypass pipe to maintain a minimum flow rate of water of the second oil cooling device.

9. The oil-injected screw air compressor of claim 1, further comprising an oil separating tank to separate the lubricating oil from compressed air.

10. The oil-injected screw air compressor of claim 1, further comprising a motor, a transmission device and a gear box to distribute power to the first stage compression chamber and the second stage compression chamber, and a suction filter and a suction throttle valve at an air inlet of the oil-injected screw air compressor.

* * * * *